US006997751B2

(12) United States Patent
Miyamoto

(10) Patent No.: US 6,997,751 B2
(45) Date of Patent: Feb. 14, 2006

(54) CARD CONNECTOR AND CONTACT TERMINAL FOR THE SAME

(75) Inventor: Osamu Miyamoto, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/100,425

(22) Filed: Apr. 7, 2005

(65) Prior Publication Data

US 2005/0181683 A1 Aug. 18, 2005

(30) Foreign Application Priority Data

Apr. 27, 2004 (JP) ..... 2004-131454

(51) Int. Cl.
*H01R 12/00* (2006.01)

(52) U.S. Cl. ..... 439/630

(58) Field of Classification Search ..... 439/630, 439/637, 862, 660, 886, 267, 870, 661, 456, 439/459, 492
See application file for complete search history.

(56) References Cited

U.S. PATENT DOCUMENTS 3,783,433 A * 1/1974 Kurtz et al. ..... 439/82
4,583,813 A * 4/1986 Yamada ..... 439/345
5,366,382 A * 11/1994 Thumma ..... 439/188
5,634,819 A * 6/1997 Pan et al. ..... 439/637
6,149,466 A * 11/2000 Bricaud et al. ..... 439/630
6,672,886 B1 * 1/2004 Billman ..... 439/82
6,685,512 B1 * 2/2004 Ooya ..... 439/630
6,905,371 B1 * 6/2005 Yi-Tse ..... 439/660
2002/0055282 A1 * 5/2002 Eldridge et al. ..... 439/66

FOREIGN PATENT DOCUMENTS

JP 2002-100440 4/2002

* cited by examiner

*Primary Examiner*—Tulsidas C. Patel
*Assistant Examiner*—Harshad C Patel
(74) *Attorney, Agent, or Firm*—Takeuchi&Kubotera, LLP

(57) ABSTRACT

A contact terminal for a card connector is comprised of a cantilever-like spring section that can be elastically displaced, a securing section to be secured to the card connector, and a connecting section to be connected to a printed circuit board by soldering. The spring section has a plurality of split spring sections, which are formed by at least splitting the end of the spring section. The plurality of split spring sections has near the end counter contact sections, which can be contacted with the contact section of the card, and at least one of the plurality of split spring sections is twisted. This contact terminal can be mounted to the card connector.

15 Claims, 11 Drawing Sheets

FIG. 6(a)
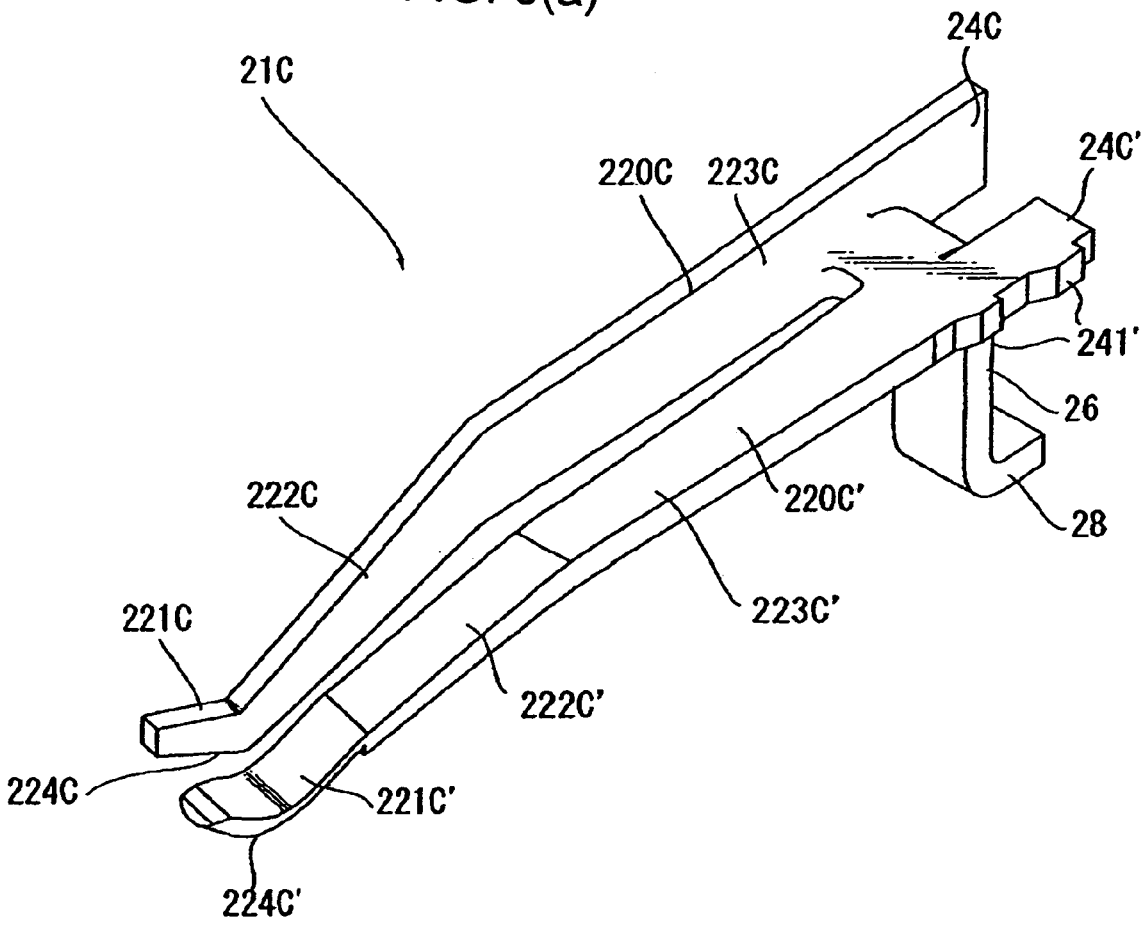
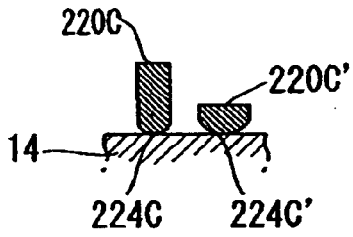
FIG. 6(b)

CARD CONNECTOR AND CONTACT TERMINAL FOR THE SAME

BACKGROUND OF THE INVENTION

1. Field of the Invention

The present invention relates to a card connector, especially a card connector having a contact terminal which has a split spring bar that is twisted, and the contact terminal for the card connector.

2. Background Technology

Many of recent electronics such as a cellular phone, PDA, personal computer, and digital camera include an IC card which is loaded with IC or memory, and reads and writes data in the loaded IC card. Usually, in such an electronic device, a card connector is provided inside of the device, or can be attached to the exterior of the device. A plurality of contact terminals for the card connector (hereinafter, "contact terminals") are arranged in the card connector, and by contacting the contact terminals with the card, data can be read or written. For example, the contact terminals include a signal terminal for signal transmission, a power terminal to supply electric power, and a ground terminal to connect a card to ground.

Usually each contact terminal has only one counter contact section for contacting with one contact section (e.g. contact pad) of the card. However, in order to improve reliability of the contact, there is a contact terminal, which has a plurality of counter contact sections for contacting with one contact section of the card. Among contact terminals, especially the power terminal and the ground terminal could significantly affect card data by the contact condition between those terminals and the contact section of the card. Therefore, there is a demand to improve the contact condition.

As an example of a conventional contact terminal, in which a plurality of counter contact sections are provided on one contact terminal, Unexamined Japan Patent Application Publication 2002-100440 is disclosed. This patent publication discloses a contact terminal, which has two counter contact sections. A perspective view of the contact terminal disclosed in the patent publication is shown in FIG. 11(*a*). An enlarged cross-sectional view of FIG. 11(*a*) taken along line A—A is shown in FIG. 11(*b*). Here, in FIG. 11(*b*), the card that contacts with the contact terminal is also partially shown. In this contact terminal 1, the end portion, i.e. spring bar 11 which can be elastically displaced and will contact with the card, is split into two portions along the longitudinal direction, and has two split spring bars 110 and 110'.

Those two split spring bars 110 and 110' can individually contact with the contact section 14 of the card at counter contact sections provided near the ends. The split spring bars 110 and 110' have different spring constants from each other, so as to prevent instantaneous break between the split spring bars 110, 110' and the contact section 14 of the card. Therefore, the resonance frequencies (natural frequencies) are differed between those split spring bars 110 and 110'. Even if the counter contact sections 114 and 114' of the split spring bars 110 and 110' come off from the contact section 14 of the card by impact or vibration, they contact with the contact section 14 at different resonance frequencies, so that the connection between the split spring bars 110, 110' and the contact section of the card can be maintained all the time.

Accordingly, the instantaneous break can be prevented. Here, as a method of changing the spring constants, a split spring bar can be partially differed from the other, especially in length, width, thickness or material of the portion that functions as a spring. For example, the above-listed patent publication discloses split spring bars 110 and 110' having different widths, and split spring bars 110 and 110' having different length due to different bending angles of the portions that function as a spring.

In case of such contact terminal having a plurality of contact sections, the plurality of contact sections have to contact with one narrow contact section of the card. Therefore, the dimension "c" between the counter contact sections 114 and 114' along the width direction has to be narrow as shown in FIG. 11(*a*). Especially, in case of having a plurality of contacts, a plurality of split spring bars 110 and 110' have to be formed according to the above-described limitation on the dimension. In addition, if the spring constants are differed between those split spring bars by differing the width of one split spring bar from that of the other, as in the example of conventional one shown in FIGS. 11(*a*) and 11(*b*), for example, the width "e" of the split spring bar 110' has to be extremely narrow.

If the split spring bar has such extremely narrow width "e", it cannot satisfactorily perform as a spring, and therefore it becomes very difficult to ensure satisfactory contact pressure between the split spring bar and the contact section 14 of the card (See f and g in FIG. 11(*b*)). As one method to solve this problem, the gap "a" between the split spring bars 110 and 110' can be reduced. However, since the gap "a" has to be larger than a certain dimension in view of preventing damaging a press tool at the time of inserting it into the gap, such method cannot be employed. Accordingly, in order to obtain ideal split spring bars, the width (especially "e") of each split spring bar has to be larger than a certain dimension in order to ensure enough contact pressure to the contact section of the card.

In addition, the gap "a" has to be larger than a certain dimension in order to prevent damaging a press tool, and the dimension between the contact points (portions) of the counter contact sections of the split spring bars has to be limited to a specified width "c".

SUMMARY OF THE INVENTION

Accordingly, it is an object of the invention to solve the above-described problems in the conventional techniques.

According to the present invention, there is provided a constitution using a plurality of split spring bars having different resonance frequencies from each other, in which the width of each split spring bar is larger than a specified length, the gap between those split spring bars is surely larger than a specified length, and the dimension between the counter contact points of the split spring bars is limited to a specified width. Furthermore, it is another object to solve so-called instantaneous break problem with the above constitution.

One embodiment of this invention is a card connector having a contact terminal for contacting with a card. The contact terminal is comprised of a cantilever-like spring section that can be elastically displaced, a securing section for securing to the card connector, and a connecting section for connecting to a printed circuit board by soldering. In this embodiment, a plurality of split spring sections, each of which has at its end the counter contact section that can contact with the contact section of the card when the card is inserted in the card connector, are formed by splitting the end of the spring section. In addition, in this embodiment, at least one of the split spring sections is twisted.

In the above card connector, the "twist" can be partially applied to the split spring section, or can be applied to the whole split spring section. Moreover, those twists can be formed by bending the split spring section obliquely relative to the extending direction of the split spring section, or can be formed by turning the split spring section. The split spring section can have different resonance frequencies from each other by changing the length or the thickness of the portion that works as a spring.

In addition, in order to change the length of the portion that works as a spring, the securing position of the split spring section can be differed from that of the other split spring section. Here, the twist can be applied either inward or outward.

Another embodiment of this invention is a contact terminal for the card connector, which is comprised of a cantilever-like spring section that can be elastically displaced, a securing section for securing in the card connector, and connecting section for connecting to a printed circuit board by soldering. In this embodiment, a plurality of split spring sections, each of which has at its end the counter contact section that can contact with the contact section of the card when the card is inserted in the card connector, are formed by splitting the end of the spring section. In addition, in this embodiment, at least one of the split spring sections is twisted.

According to the present invention, in the constitution which has the plurality of split spring bars having different resonance frequencies from each other, there is provided a contact terminal that exhibits satisfactory performance and ensures easy production, while keeping the dimensions of the split spring bars within the limit.

BRIEF DESCRIPTION OF THE DRAWINGS

FIGS. 6(*a*) and 6(*b*) show a contact terminal according to the third embodiment of the invention.

BEST MODE TO CARRY OUT THE INVENTION

Figure 1:
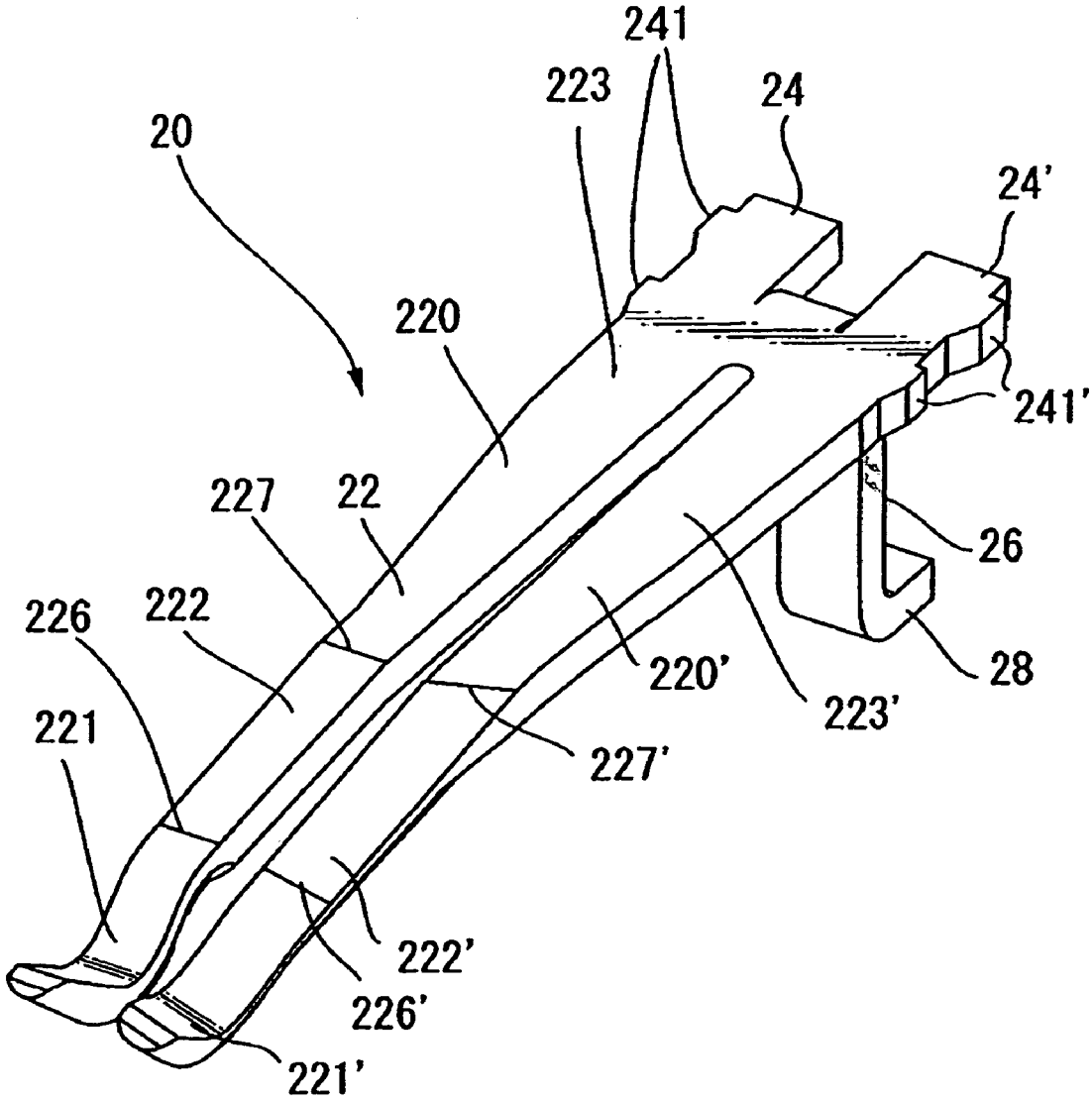
FIG. 1 is a perspective view of the contact terminal according to the first preferred embodiment of the invention.
Figure 2C:
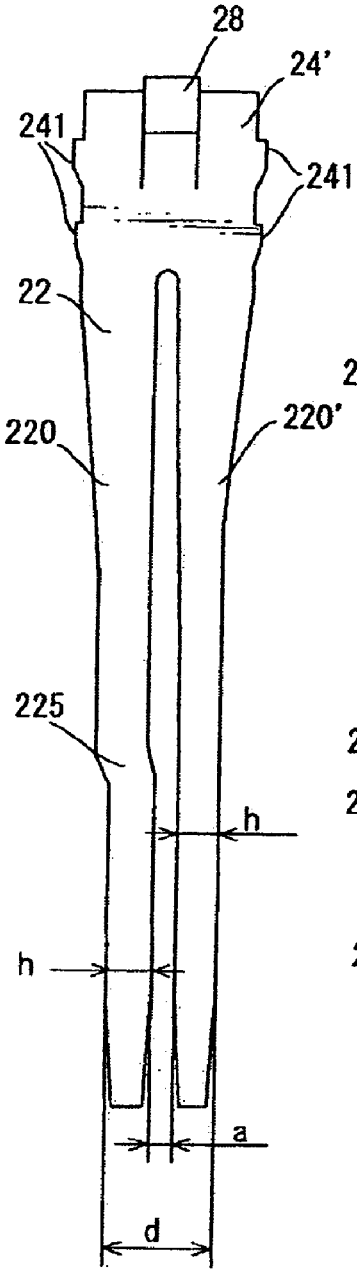
FIGS. 2(*a*)–2(*c*) are top view and side views of the contact terminal of FIG. 1, and top view of the contact terminal right after die-cutting.
Figure 2A:
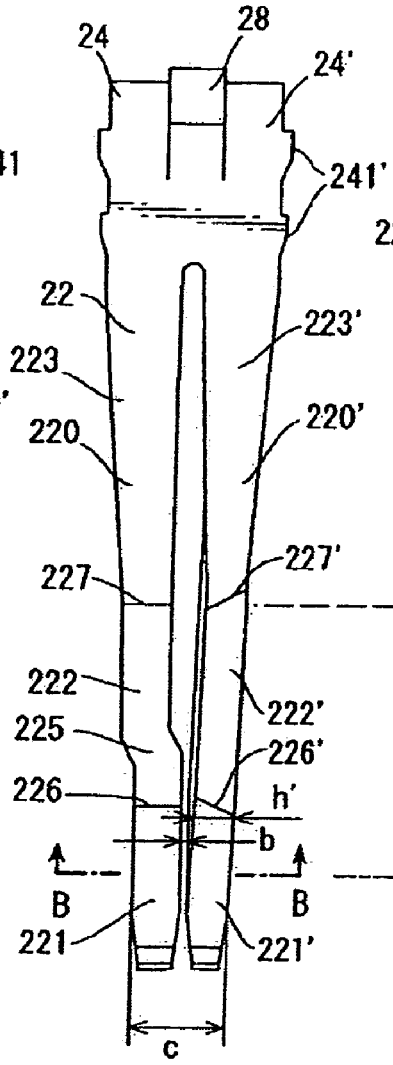
Figure 2B:
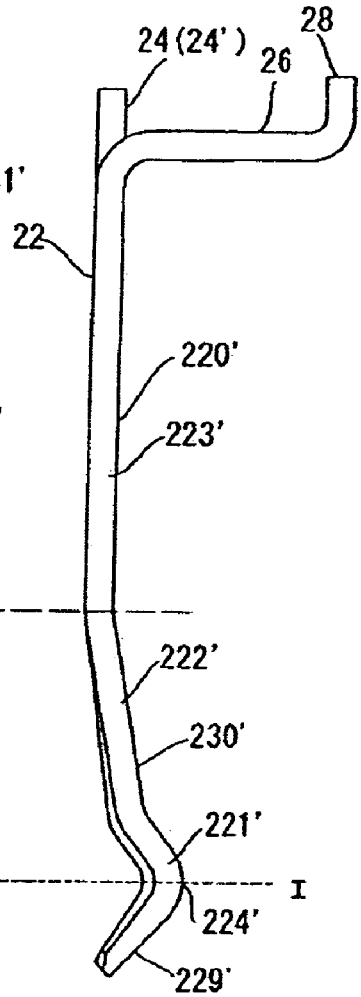
Figure 3A:
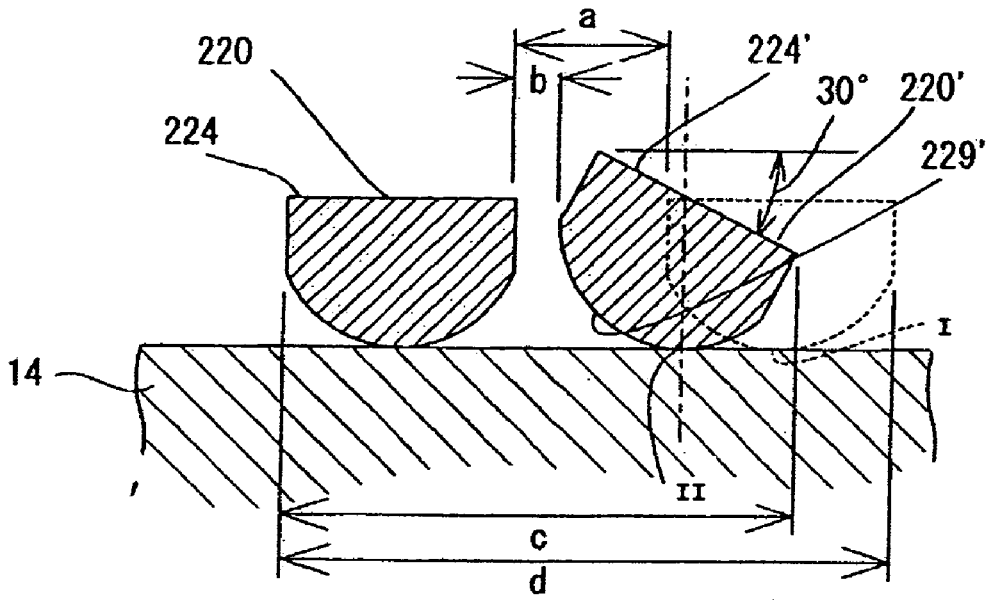
FIG. 3(*a*) is an enlarged cross-sectional view of FIG. 2(*a*) taken along line B—B, and FIG. 3(*b*) shows an example of alteration of FIG. 2(*a*).
Figure 3B:
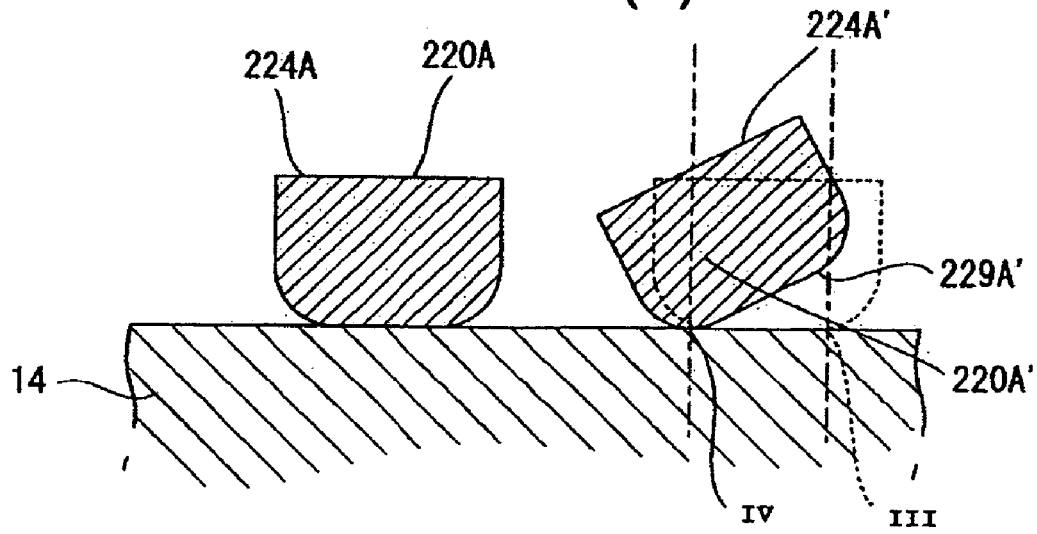

In FIGS. 1 to 3(*a*) and 3(*b*), a contact terminal 20 is comprised of a cantilever-like spring piece 22 that can be elastically displaced, a pair of press-in sections 24 and 24', which are formed at the base portion of the spring piece 22 and will be pressed and secured into/at a specified position of the card connector, an arranging leg 26 that is provided between the pressing-in sections 24 and 24' and will be disposed in a specified arranging groove of the card connector, and a connecting section 28 for connecting to a specified position of the printed circuit board by soldering.

The end of the spring piece 22 is split into two parts along the longitudinal direction, so as to have two split spring bars 220 and 220'. Here, the end of the spring piece 22 can be split into three or more. Each split spring bar 220 (220') is comprised of a plurality of spring bar units that are bent at different positions, e.g. comprised of a front end spring bar unit 221 (221'), a middle spring bar unit 222 (222'), and a rear end spring bar unit 223 (223').

For example, this contact terminal 20 can be made from a thin metal sheet. After die-cutting the metal sheet into a specified shape by presswork or the like, the extending portion of the spring piece 22 is bent downward for about 90° so as to form the arranging leg 26, and then the end section of the arranging leg 22 is bent outward for about 90° so as to form the connecting section 28 (See FIG. 2(*c*)). Then, the split spring bars 220 and 220' of the spring piece 22 are formed (See FIGS. 1, 2(*a*) and 2(*b*)). Here, the portion near the end of the split spring bars 220 and 220', especially the edge sections of the counter contact sections 224 and 224', which will contact with the contact section of the card, can have hemispherical shape (See FIG. 3(*a*)) after presswork so as not to damage the card when it contacts with the card.

Figure 11A:
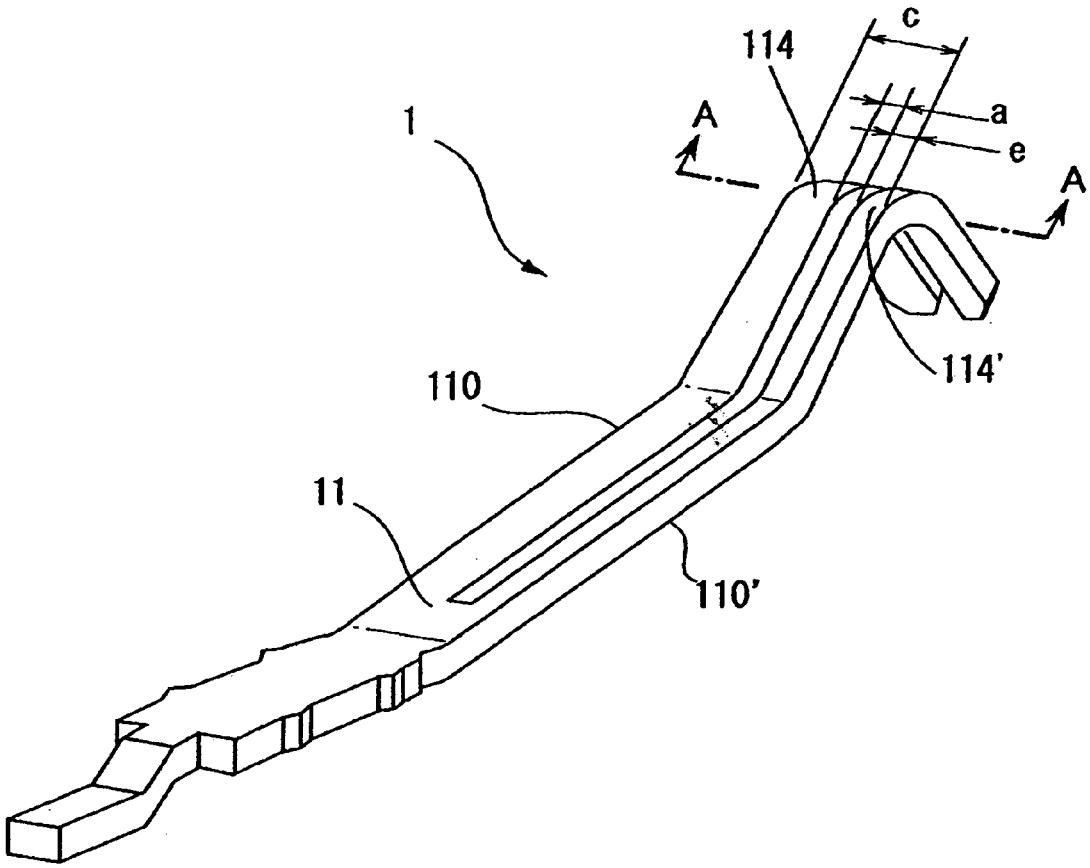
FIG. 11(a) PRIOR ART
FIGS. 11(*a*) and 11(*b*) are a perspective view and a cross-sectional view of the conventional contact terminal.
Figure 11B:
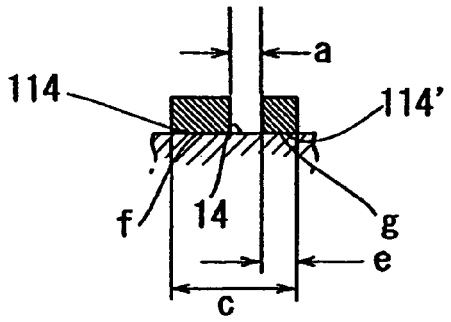
FIG. 11(b) PRIOR ART

As obvious from FIG. 2(*c*), the portion near the end of the contact terminal 20, especially each width h, h' of the counter contact sections 224 and 224' is set larger than "e" in FIGS. 11(*a*) and 11(*b*), which illustrates a conventional device. In addition, the dimension "d" of the counter contact sections 224 and 224' in the width direction is also set larger than "c" in FIGS. 11(*a*) and 11(*b*). As described above, dimensions at specified portions of the split spring bars 220 and 220' before processing are set larger than those of conventional device illustrated in FIGS. 11(*a*) and 11(*b*), but there is no problem as will be apparent from the description below. Here, the gap between the split spring bars 220 and 220' is set same as "a" in FIGS. 11(*a*) and 11(*b*), but even this gap can be set larger than that in FIGS. 11(*a*) and 11(*b*) as will be apparent from the description below. Here, a deformed section 225 is provided near the middle portion of the split spring bar 220 so as to make it close to the other split spring bar 220', in order to reduce the gap at the time of die-cutting.

To process the spring piece 22, the front end spring bar unit 221 itself is curved to form a C-shape, so as to form an arc counter contact section 224, which will be used as a contact section 14 of the card. Then, the split spring bar 220 is bent at the bending line 226 between the front end spring bar unit 221 and the middle spring bar unit 222, and at the bending line 227 between the middle spring bar unit 222 and the rear end spring bar unit 223, which are generally perpendicular to the extending direction of the split spring bar 220. This bending process can be easily performed, for example, by presswork.

On the other hand, a relatively large first twist is made on the split spring bar 220' at the oblique line 227', which is slightly oblique relative to the direction generally perpendicular to the extending direction of the split spring bar 220' between the middle spring piece unit 222' and the rear end spring piece unit 223', by bending downward in the thickness direction of the spring piece 22. Here, the direction of the twist is inward, i.e. the bottom surface (229' in FIG. 2(*b*)) faces the other split spring bar 220 when the cross section of the front end spring bar unit 221' is viewed in the extending direction. By applying such inward twist, the split spring bar 220' can be significantly close to the split spring bar 220.

Furthermore, the split spring bar 220' has a relatively small second twist at an oblique line 226', which is slightly oblique relative to the direction generally perpendicular to the extending direction of the split spring bar 220', between the front end spring bar unit 221' and the middle spring bar unit 222' by bending downward in the thickness direction of the spring piece 22. Here, the direction of this twist is outward, which is opposite to the above one, i.e. the bottom surface (203' in FIG. 2(*b*)) faces the other split spring bar 220 when the cross section of the middle spring piece unit 222' is viewed in the extending direction. By applying such outward twist, it is prevented that the split spring bar 220' becomes too close to (i.e. contact with) the other split spring bar 220 by arranging them slightly away from each other. Here, in this embodiment, the direction of the first twist is different from that of the second one, but they can be same, or different bending directions can be combined.

Before those two twists are made, an arc counter contact section 224' is formed specifically at the front end spring bar unit 221' similarly to the front end spring bar unit 221. Here, as already obvious from broken line I in FIG. 2(*b*), since the contact points of the counter contact sections 224 and 224' that contact with the contact section 14 of the card are juxtaposed in the width direction of the spring piece 22 (straight direction perpendicular to the longitudinal direction of the spring piece 22), presswork is made easier.

As apparent, those twists help to increase the elasticity of the split spring bar 220'. In addition, as fully illustrated in FIG. 3(*a*), those twists change the contact position of the counter contact section 224' to the contact section 14 of the card (In this figure, it changes from "I" to "II"). Such changes in elasticity and contact position change the contact pressure to the contact section 14 of the card, and even change the resonance frequency of the split spring bar 220'. Therefore, the constitution of this invention can be used to solve the short break problem.

Here, in the example illustrated in FIGS. 2(*a*)–2(*c*), twist is applied only on one split spring bar 220', which differs the resonance frequency. Therefore, the split spring bars 220 and 220' can have same length and shape, and can be made from same material at the time of die-cutting process. Accordingly, the contact terminal 20 can be easily made, for example, from a metal sheet that has an even thickness and is made of a same material that is evenly plated. Here, by additionally changing other factors other than twist, i.e. length, width, thickness and material of the split spring bar, the resonance frequency can be differed between the split spring bars. In this case, the resonance frequency can be differed regardless of the material or thickness of the metal sheet.

Those twists solve the instantaneous break problem by differing the resonance frequency of one split spring bar from that of the other, and also can help to make the counter contact sections 224 and 224'(split spring bars 220 and 220') close to each other. In other words, by applying those twists, the gap "a" between the split spring bars 220 and 220' can be reduced to "c", for example. In addition, the dimension "b" between the counter contact sections 224 and 224' in the width direction can be reduced to "c". Here, the gap "b" between the split spring bars 220 and 220' is smaller than "a"which is minimum length to prevent the press tool from damage, but is equal to "a" at least at the time of die-cutting, and therefore there is no problem. Moreover, according to the constitution of this invention, in addition to that exterior dimensions (d, c) are reduced, the contact position can be changed so as to make one close to the other as is changed from I to II, so that the dimension in the width of the contact section 14 of the card can be also reduced.

The degree of the twist depends on the resonance frequency to set, and positions and the number of the twists to apply. For example, in the example illustrated in FIGS. 2(*a*)–2(*c*), by applying an inward twist, the bottom surface 229' faces the counter contact section 224 of the other split spring bar when the cross section of the counter contact section 224' is viewed in the extending direction, as shown in FIG. 3(*a*). Here, the inward twist is applied because it is considered that the gap between the counter contact sections 224 and 224' (the gap between the split spring bard 220 and 220') can be set smaller by applying the inward twist in the case illustrated in FIG. 3(*a*) .

FIG. 3(*b*) shows another embodiment related to the direction of twist. In this figure, an embodiment, in which an outward twist is preferred to an inward twist, is illustrated. Here, in FIG. 3(*b*), members similar to those in FIG. 3(*a*) are labeled by "A" after the reference numeral. In the example illustrated in FIG. 3(*b*), the edge section near the counter contact sections 224 and 224A' does not have semispherical shape, but has generally round shape. In addition, in this example, the twist is applied on the split spring bar 220*a* not by bending, but by turning the split spring bar itself at the position. Here, "twist" in this invention includes twist without bending (i.e. turning). As can be imagined from the figure, in the case illustrated in this example, the gap between the counter contact sections 224 and 224A' can be reduced more by applying the twist outward, not inward. In addition, the contact position can be also changed from II to IV so as to make it close to the counter contact section 224A.

As apparent from the above description, in this invention, where a plurality of split spring bars 220 and 220', have different resonance frequencies, the width between the split spring bars 220 and 220' can be maintained not smaller than a specified length, and the gap between those spring bars can be maintained not smaller than a specified length at least at the time of die-cutting. In addition, after shaping, the dimension of the split spring bars 220 and 220', especially the one near the end in the width direction can be limited to a specified width.

Figure 4:
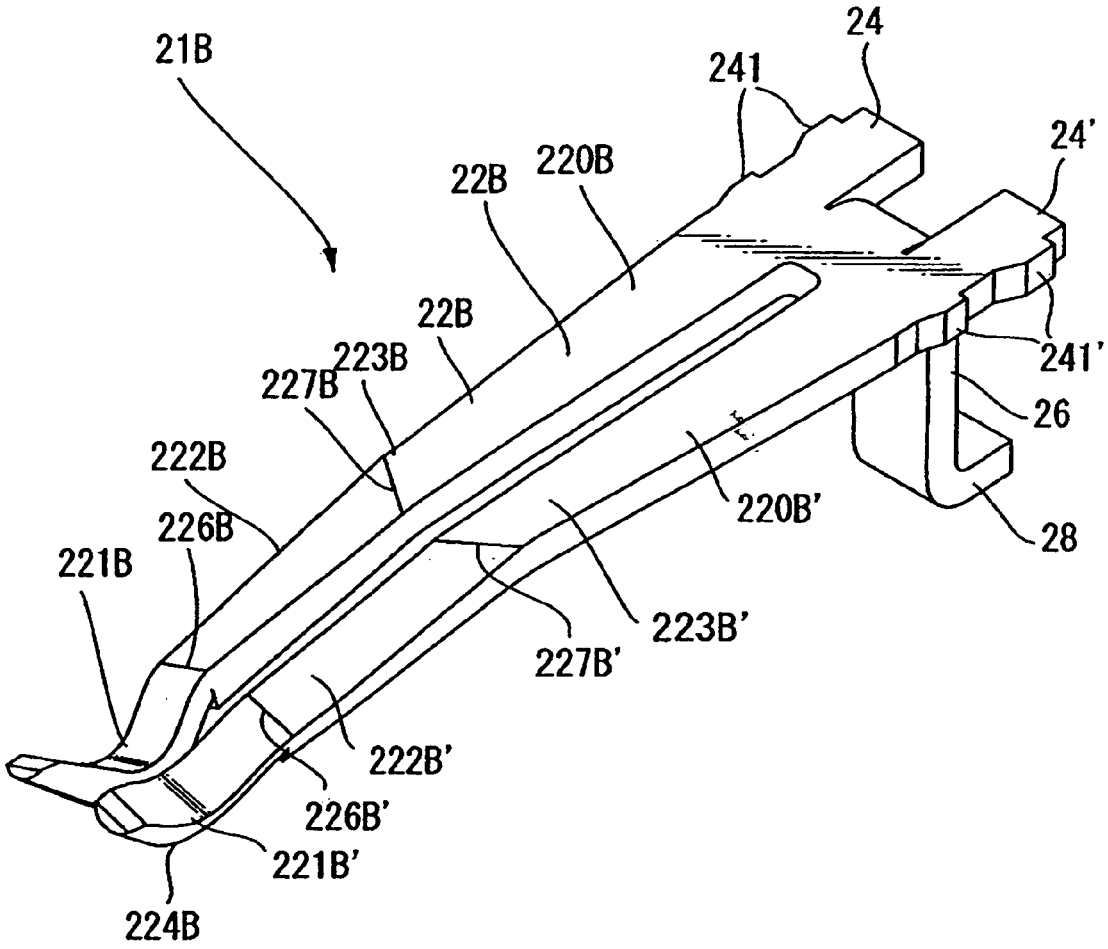
FIG. 4 is a perspective view of a contact terminal according to the second embodiment of the invention, which is correspondingly illustrated to the first embodiment in FIG. 1.
Figure 5A:
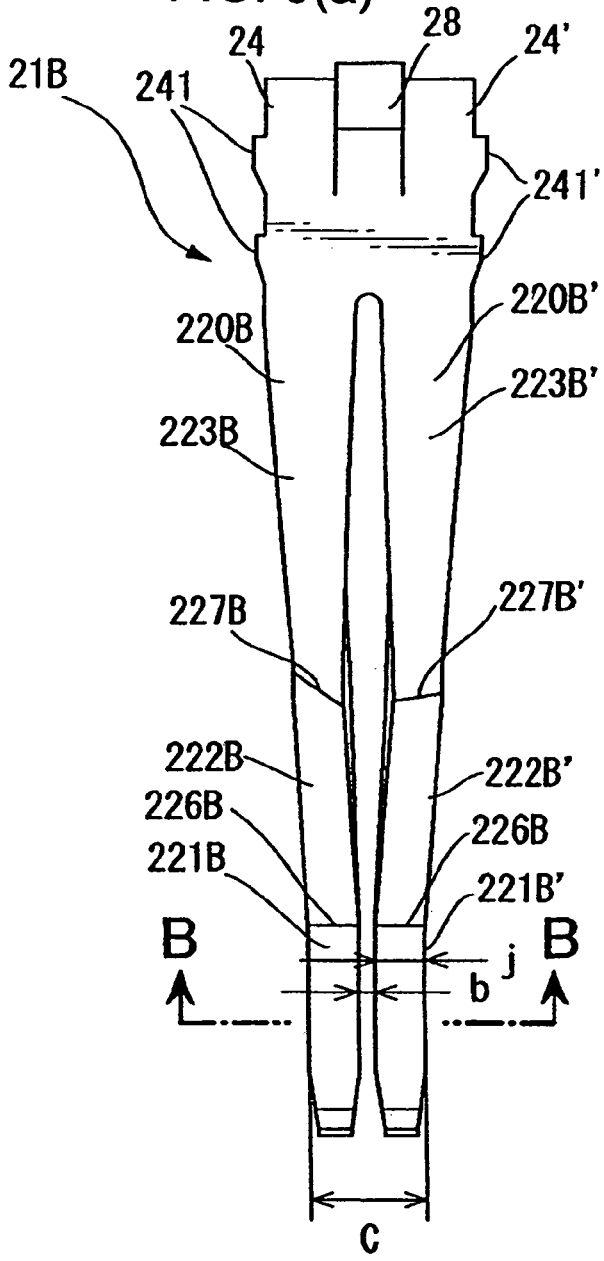
FIGS. 5(*a*) and 5(*b*) show a contact terminal of the second embodiment of this invention, which is correspondingly illustrated to the first embodiment in FIGS. 2(*a*) and 3(*a*).
Figure 5B:
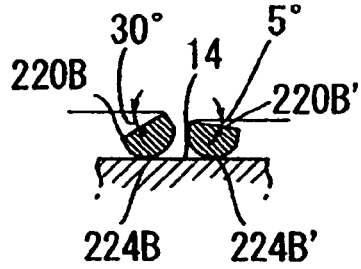

FIGS. 4, 5(*a*), and 5(*b*) show the second embodiment of the contact terminal 21B. Here, FIG. 4 corresponds to the first embodiment in FIG. 1, and FIGS. 5(*a*) and 5(*b*) correspond to FIG. 2(*a*) and FIG. 3(*a*), respectively. In those figures, members similar to the ones illustrated in FIGS. 1 and 2(*a*)–2(*c*) are labeled by "B" after respective reference numerals.

While a twist is applied only onto one split spring bar 220' in the first embodiment, in the second embodiment, a twist is applied onto one portion of each split spring bar 220B and 220B'. In other words, between the front end spring piece unit 221B and the middle spring piece spring unit 222B, each split spring bar 220B (220B') is bent downward in the thickness direction of the spring piece 22 at the bending line 226B (226B'), which is generally perpendicular to the extending direction of the split spring bar 220B (220B'). On the other hand, between the middle spring bar unit 222B and 222B' and the rear end spring bar unit 223B and 223B', each split spring bar 220B (220B') is bent inward and downward in the thickness direction of the spring piece 22 at the oblique line 227' (227B'), which is slightly oblique relative to the direction generally perpendicular to the extending direction of the split spring bar 220B (220B'). Here, since the degrees of the angle are different between the bending lines 226B and 226B', the degree of the twist between the middle spring bar unit 222B and the rear end spring bar unit 223B is different from that between the middle spring bar unit 222B' and the rear end spring bar unit 223B'. For example, as shown in FIG. 5(*b*), while the angle of the split spring bar 220 is about 30°, that of the split spring bar 220B' is about 5°.

Here, in case that both split spring bars are twisted, the width of each split spring bar 220B (220B') can be set "j", which is larger than "e" in FIGS. 11(*a*) and 11(*b*) and larger than "h" in FIG. 2(*a*). With those twists, each split spring bars 220B (220B') can be made close to the other split spring bar 220B' (220B), and also the dimension of the each spring bar 220B (220B'), especially that near the front end in the width direction, can be reduced to "c", which is within the limit.

In addition, in case of twisting both split spring bars, if a twist is symmetrically applied onto same position of each split spring bar at same angle, and the split spring bars are made by die-cutting and have same shape and size, the resonance frequencies of those split spring bars are same. However, even in this case, as shown in FIGS. 4, 5(*a*), and 5(*b*), the resonance frequencies of those split spring bars can be differed from each other by differing the position of the twist, and in addition, by differing other factors, e.g. length, width, thickness and material of the split spring bars.

FIG. 6(*a*) and 6(*b*) show the third embodiment of the contact terminal 21C. Here, FIG. 6(*a*) corresponds to the first embodiment in FIG. 1, and to the second embodiment in FIG. 4. FIG. 6(*b*) corresponds to the first embodiment in FIG. 3(*a*), and to the second embodiment in FIG. 5(*b*). In FIGS. 4, 5(*a*), and 5(*b*), members similar to those of the spring piece in FIGS. 1, 2(*a*), and 2(*b*), are labeled by "C" after the respective reference numerals.

In the first embodiment and the second embodiment, the twist is applied on the middle of the split spring bar, and the middle spring bar unit and the front end spring bar unit are twisted relative to the rear end spring bar unit. In this embodiment, a twist is applied on the whole split spring bar, more specifically the split spring bar 220C and press-in section 24C that connects to the split spring bar 220C. Therefore, the whole split spring bar 220C faces the direction generally perpendicular to the other split spring bar 220C', especially when the cross sections of the rear end spring bar unit 223C' and press-in section 24C' are viewed in the extending direction. Here, as for the split spring bar 220C', it can be considered that a twist similar to the one made on the split spring bar 220B' in the second embodiment, which is shown in FIG. 4, is applied. By applying such twists, the resonance frequencies can be differed between the split spring bars 220C and 220C'. In addition, the split spring bars 220C and 220C' can be made close to each other, which enables overcoming the problems related to the dimension.

Figure 7:
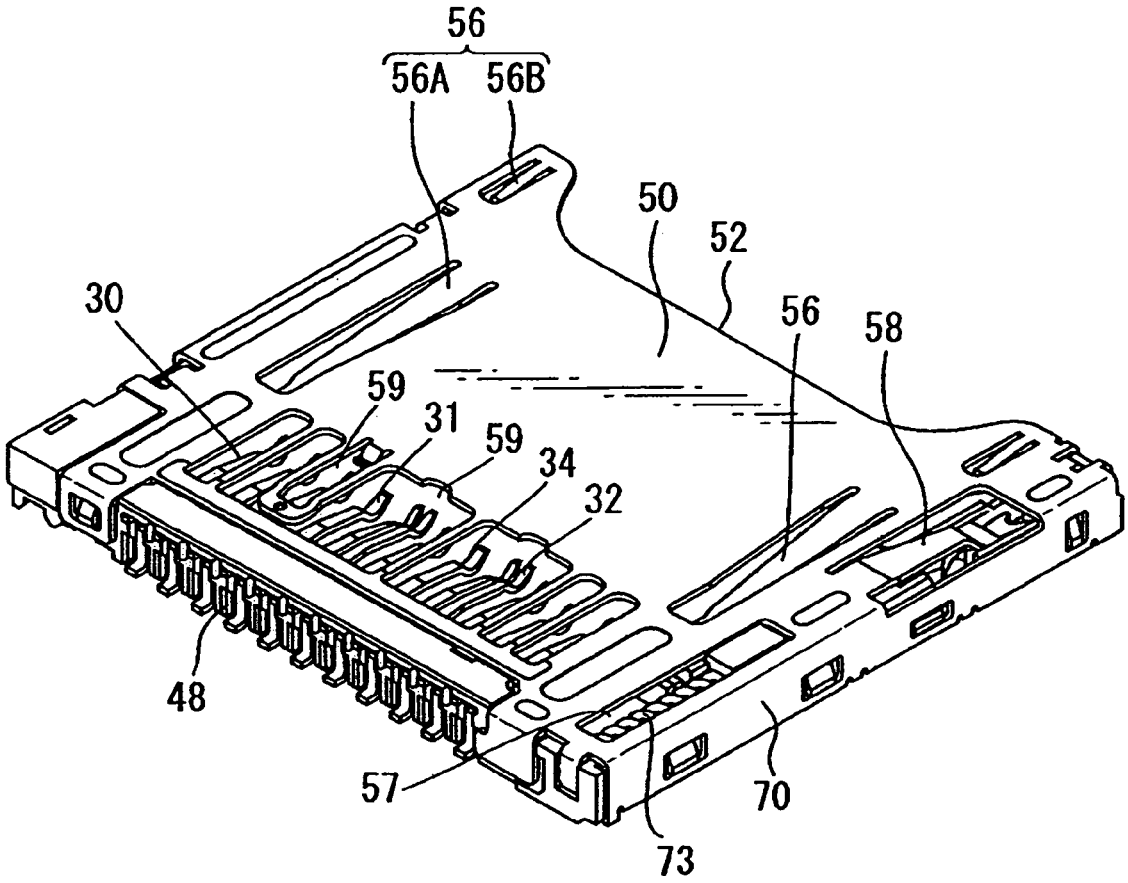
FIG. 7 is a perspective view of the completed card connector using the contact terminal of the invention.
Figure 8:
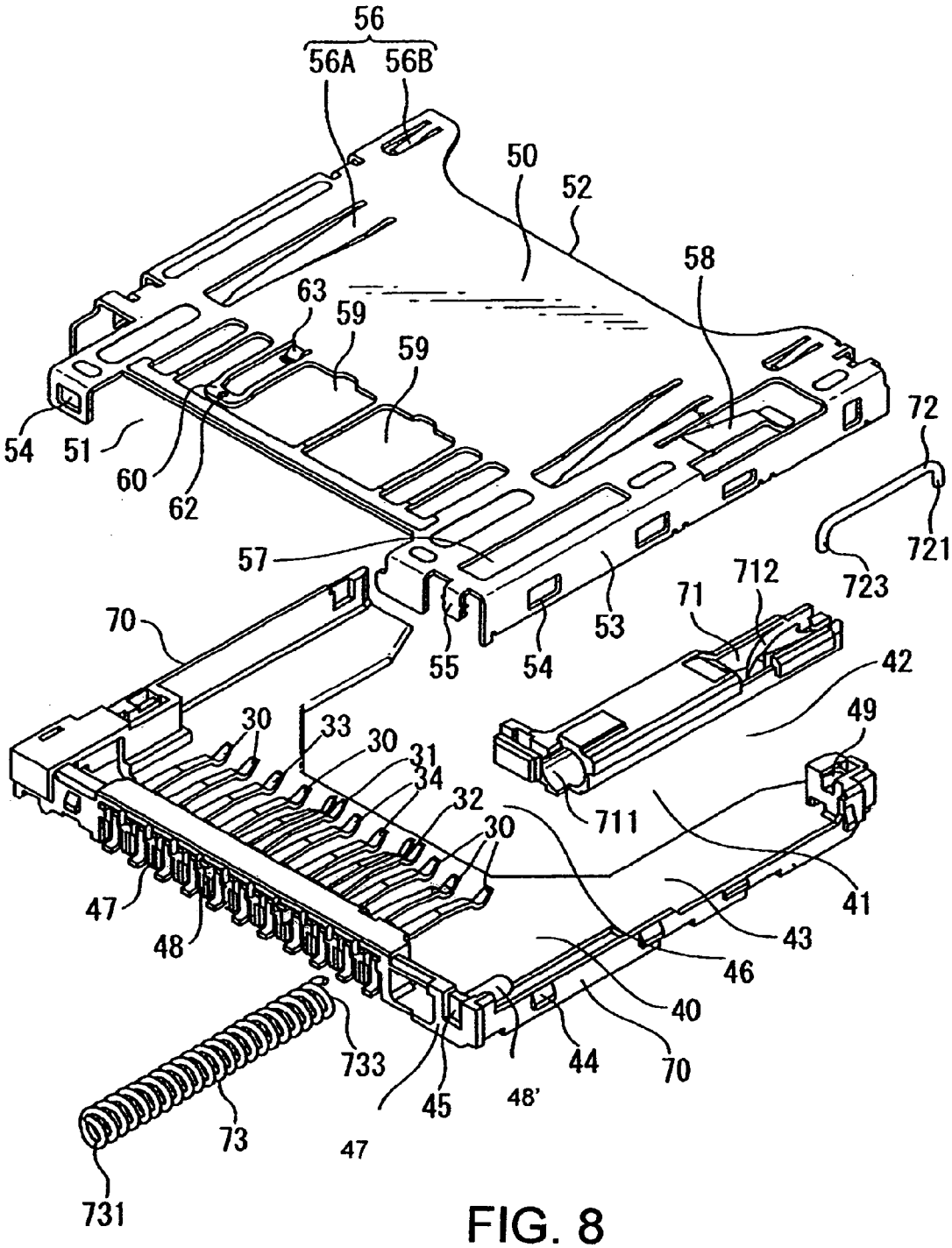
FIG. 8 is an exploded perspective view of FIG. 7.

Referring now to FIG. 7 and 8, one embodiment of a card connector using the contact terminal according to embodiments of this invention illustrated in FIGS. 1 to 5(*a*)–5(*c*) will be explained. Here, FIG. 7 is a perspective view of the completed card connector, and FIG. 8 is an exploded perspective view, which is obliquely viewed from the front side.

The card connector is comprised of an insulating housing 40, contact terminals to attach to the insulating housing 40, e.g. a signal terminal that reads and writes data by contacting with the card, a power terminal 31 that supplies electric power to the card and a ground terminals 32 and 33 to connect the card to ground, and a spare terminal 34, i.e. an unused terminal provided for future use, a metal cover 50, and a member for controlling insertion/ejection of the card, e.g. an ejector 71, a pin 72 and a spring 73. The card (not illustrated) to be inserted into the connector can be considered TO card, which is commonly used. On the surface of the IC card, a plurality of contact sections including a signal contact section (pad section) for signal transmission, a power contact section (pad section) for power connection, and ground contact sections (pad sections) for ground connection, corresponding to the contact terminals 30–34 are provided. Here, the number and positions of the contact terminals arranged on the card connector and the number and positions of the contact sections on the card, which correspond to those of the contact terminals, are usually determined according to the specification. In this embodiment, according to one of the specifications, eleven contact terminals are arranged, for convenience.

The insulating housing 40 is made of an insulating material such as a synthetic resin, and has generally U-shape. The upper side 41 and the rear side 42 of the insulating housing 40 are opened. Especially, the opened upper side 41 is substantially covered by the metal cover 50. In order to secure the metal cover onto the insulating housing 40, a protrusion having a slant surface 44, a catching section 45, and so forth are provided on the side surfaces (i.e. left and right side surfaces 70 and the front side surface 47) other than the opened rear side 42, as necessary. When the metal cover 50 is secured onto the insulating housing 40, a hollow card receiving space 46 to place the IC card therein is formed by the insulating housing 40 and a part of the metal cover 50. The IC card is inserted/ejected into/from the card receiving space 46 through the opened rear side 42.

A plurality of contact terminal arranging sections 48 are provided on the front side surface 47 of the insulating housing 40 for arranging the contact terminals 30–34. The contact terminals 30–34 are inserted from the front side into holes of the contact terminal arranging sections 48 in the inserting/ejecting direction of the IC card, and secured therein by pressing the catches 241 and 241' of the press-in sections 24 and 24' of the contact terminals 30–34 into the respective holes. When the IC card is inserted and placed in the card receiving space 46, those contact terminals 30–34 displace in the thickness direction of the terminals, i.e. upward/downward in the direction generally perpendicular to the direction of inserting the IC card into the card receiving space 46, and elastically contact with the corresponding portions of the signal contact section and ground contact sections on the IC card surface.

A mounting space 43 for mounting a member for inserting/ejecting IC card, e.g. an ejector 71, a pin 72 and a spring 73, is provided on the left side surface, which is on the left when it is viewed from the opened rear side surface 42. On the front side of the mounting space 43, a cylindrical protrusion 48' for positioning the spring 73, which extends toward the mounting space from the inner wall of the front side surface 47 of the insulating housing 40, is provided. On the other hand, a hemispherical catching section 49 for positioning the end 721 of the pin 72 extending in the direction perpendicular to the extending direction of the pin 72 is provided on the rear side surface of the mounting space 43, such that the end 721 is freely rotatable therein within a specified range of angle. The end 731 of the spring 73 is mounted to the positioning cylindrical protrusion 48' so as to surround the outer portion of the positioning cylindrical protrusion 48', and the other end 733 of the spring 73 is inserted into the spring inserting hole 711, which is provided on one end of the ejector 71, against the energizing force of the spring 733.

Furthermore, the end 721 of the pin 72 is arranged on the hemispherical catching section 49, and the other end 723 of the pin 72 is arranged around a heart-shaped lock cam 71 provided on the other end of the ejector 71 so as to be slidable, so that push-type mechanism for inserting/ejecting the IC card can be formed.

The metal cover 50 can be made, for example, by die-cutting a thin sheet metal such as a stainless steel sheet, and then bending. This metal cover 50 covers the outer portion of the insulating housing 40. The metal cover 50 can work as a shielding as well as for protection from impact. The generally center portion of the front side 51 of the metal cover 50 is opened in order to expose the contact terminals 30–34. Similarly, generally whole part of the rear side 52 is opened for inserting the IC card. On the other hand, the left and right side surfaces 53 are substantially closed. On those side surfaces 51–53, a securing hole 54 and a securing protrusion 55 are provided as necessary corresponding to the protrusion 44 having a slant surface and the rectangular catching section 45 of the insulating housing 40.

Two pairs of card-holding displaceable sections 56A and 56B, which have different sizes and formed by cutting and slightly pulling down a part of the metal cover 50 toward the card receiving side, are provided at the rear sides on the upper surface of the metal cover 50. With those card-holding displaceable sections 56, the card inserted into the card receiving space 46 can be pushed upward/downward, so that coming off of the IC card from the card receiving space 46 can be prevented.

In addition, a rectangular access hole 57 is provided at the front sides on the upper surface of the metal cover 50, so as to enable easy access to the spring 73 or the like, which is mounted on the insulating housing 40. Furthermore, a pin-holding displaceable section 58, which is formed by cutting and pulling down a part of the metal cover toward the card receiving side, is provided on the upper surface of the metal cover 50, specifically above the mounting space 43 of the insulating housing 40, in order to press the pin 72 arranged on the mounting space 43 from the upper side.

Escape holes 59, which are respectively formed by cutting out a part of the metal cover 50, are provided at the front portion on the upper surface of the metal cover 50, corresponding to the respective contact terminals 30–34. When the IC card is inserted into the card receiving space 46 and the signal terminal 30, the power terminal 31, the ground terminals 32 and 33 and the spare terminal 34 displace upward, with those escape holes 59, the portions near upper ends 221 of the displaced contact terminals can be escaped outside of the card receiving space 46.

By deforming a part of the metal cover 50, the ground piece 60 is formed. The ground piece 60 has generally rectangular frame shape as a whole. The ground piece 60 is cantilever-like, and extends in the direction of inserting the IC card into the card receiving space 46, and is provided so as to be right above the ground contact section, which is provided on the surface of the IC card, when the IC card is inserted in the card receiving space 46. The ground piece 60 is exposed to the card receiving space 46 at least at the side facing the card receiving space 46. As a result, the ground piece 60 can directly contact with the ground terminals 32 and 33. The ground piece 60 has a function of connecting the IC card with ground 6 via the contact with the ground terminal 22.

The end portion of the ground piece 60 is positioned downward as a whole by bending near the end portion. In addition, a curved convex section 62, which protrudes further downward, is formed at the end of the end portion by rolling process. The ground piece 60 can directly contact with the ground terminals, for example, all the time (at least when the IC card is inserted in the card receiving space 46), through the curved convex section 62.

A card restricting section 63 is formed near the base portion of the ground piece 60 by deforming a part of the metal cover 50. This card restricting section 63 is configured so as to protrude inward of the escape hole 59 and toward the card receiving space 46, and is designed to contact with the ground contact section provided on the IC card surface.

Figure 9:
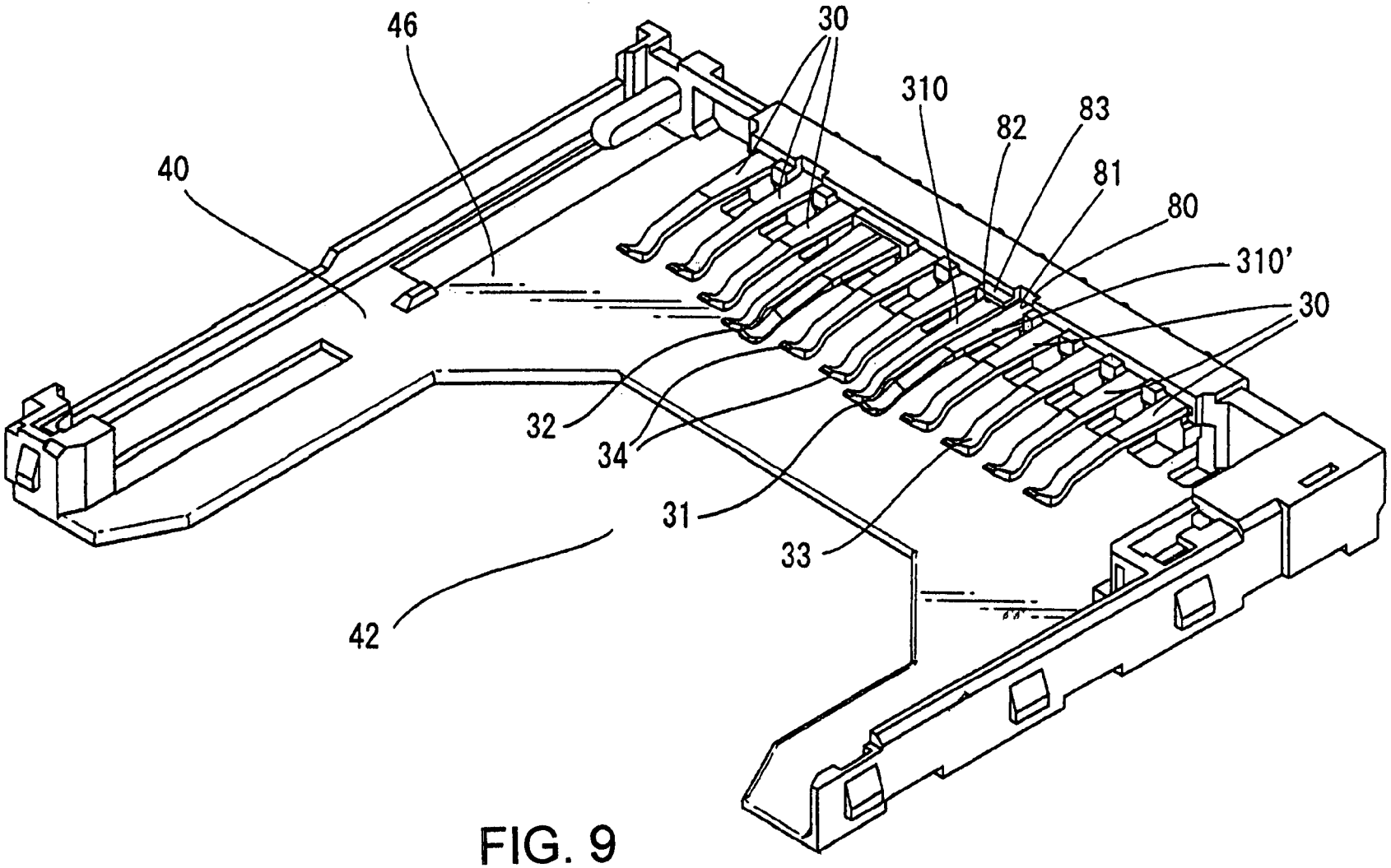
FIG. 9 is a perspective view of an alteration in the insulating case of the invention.

FIG. 9 shows an example of alteration of the card connector illustrated in FIGS. 7 and 8, more specifically, an example of alternation of the insulating case. FIG. 9 is an exploded perspective view, in which only contact terminals 30–34 are secured in the altered insulating case 40, and obliquely viewed from the upper side but in the card inserting direction. In this example of alteration, by changing the position of the securing section by the insulating case 40, the lengths of the split spring bars are differed, and therefore the resonance frequencies are differed.

Here, more specifically, attention is paid to the position of the securing section in the insulating case 40 when the split spring bars 310 and 310' are displaced. By differing the positions between those split spring bars, the actual lengths of the split spring bars 310 and 310' can be differed while keeping the original lengths of the split spring bars same. In the description below, power terminal 31 is used as an example, but of course, this example of alteration can be similarly applied to other contact terminals 30, 32, 33 and 34.

In the example illustrated in FIG. 9, as for the portion supporting one split spring bar, e.g. twisted split spring bar 310', the upper portion of the boundary portion 80 of the insulating case 40 with the securing section of the power terminal 31 is removed. On the other hand, as for the portion supporting the other split spring bar, e.g. untwisted split spring bar 310, the boundary portion 83 of the insulating case 40 with the securing section of the power terminal 31 protrudes forward and is secured onto the split spring bar 310. As a result, the position 81 of the split spring 310' held on the insulating case 40 when it displaces upward is closer to the end of the base portion of the split spring bar 310', in comparison when the other split spring bar 310 similarly displaces upward. Accordingly, when they displace upward, the split spring bar 310' displaces with longer spring length than the other split spring bar 310. In other words, at the time of upward displacement, the effective lengths of the split spring bars 310 and 310' are different from each other.

As a result, the resonance frequencies of those split spring bars 310 and 310' are different from each other. Of course, the upper portion of the insulating case 40, which supports the split spring bar 310, can be removed, and correspondingly, the portion that supports the other split spring bar 310' can protrude forward and be secured onto the split spring bar 310'. Alternatively, not the upper portion of the split spring bar 310 (310'), but the lower portion can be removed or protruded so as to differ the securing position on the lower sides for holding and securing the split spring bars between the split spring bars 310 and 310'. According to those methods, with relatively small alteration in design of the insulating case 40, the resonance frequency can be differed between the split spring bars. Accordingly, for example, even when a twist is symmetrically applied to the split spring bars, which have same shape and dimensions and are made from same material, at same position with same angle, the resonance frequencies can be differed between those split spring bars.

Figure 10:
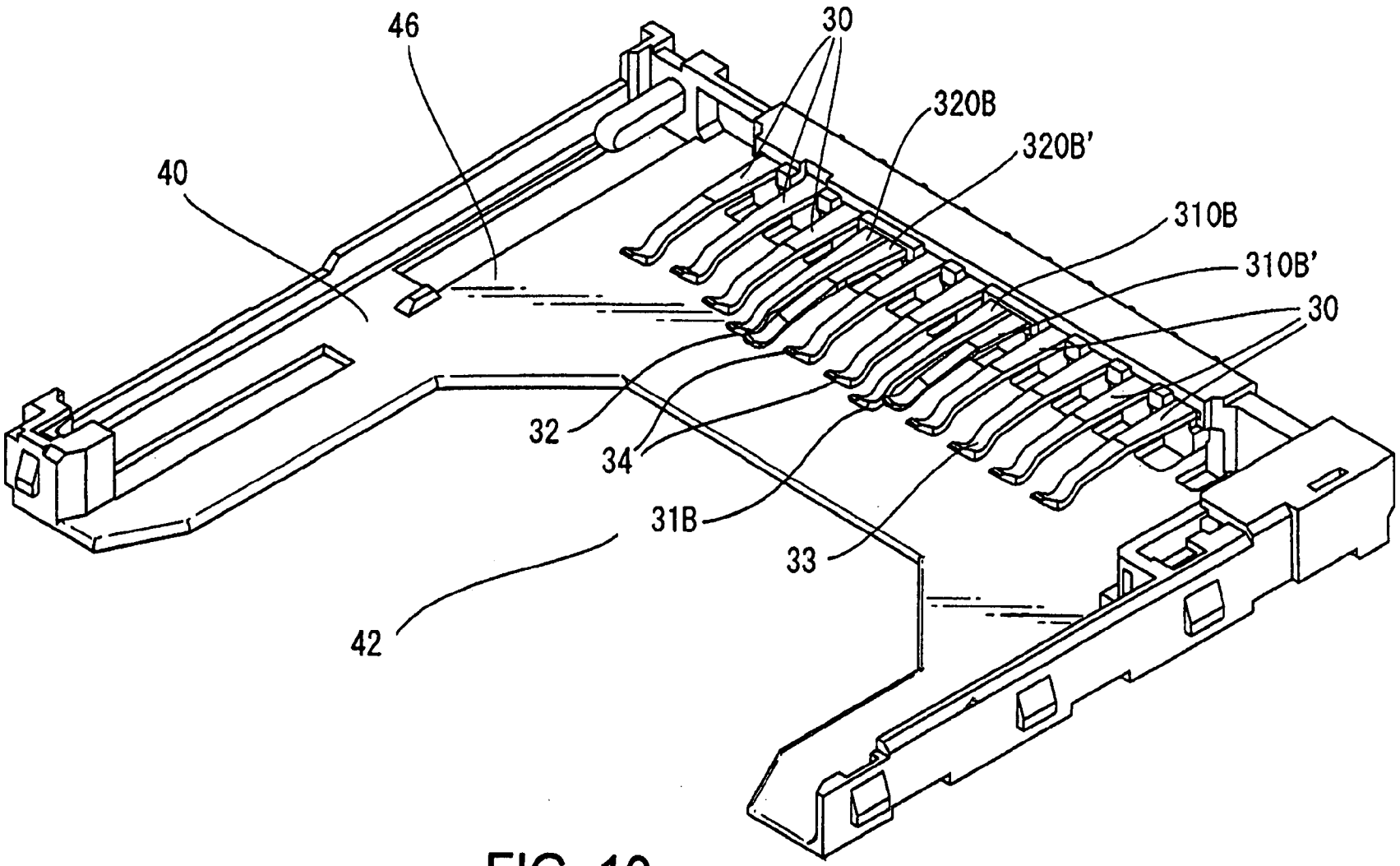
FIG. 10 is a perspective view of an alteration of FIG. 9.

FIG. 10 shows another example of alteration of FIG. 9, and corresponds to FIG. 9. In this figure, as for the power terminal 31B, by applying a twist on the split spring bar 310B' so as to make the length of the other split spring bar 310B longer than the twisted split spring bar 310B', the resonance frequencies are differed between the split spring bars 310B and 310B'. In addition, as for the ground terminal 32, in addition to applying a twist on the split spring bar 320B', the thickness of the other split spring bar 320B is set smaller than the split spring bar 320B'. Tn other words, in addition to twisting, the thicknesses can be differed between the split spring bars 320B and 320B', so as to differ the resonance frequency. Here, the alteration of the thickness can be done by various methods such as rolling, plating process, and addition of metal sheet.

Here, in the example illustrated in FIG. 10, the length of the split spring bar is altered for the power terminal 31B, and the thickness of the split spring bar is altered for the ground terminal. However, both the thickness and the length can be altered for the power terminal 31B or the ground terminal 32. Furthermore, the width or material can be altered, and any alteration can be suitably combined.

In the above embodiments, a portion between the front end spring piece unit 221 and the middle spring piece unit 222 is simply bent upward/downward. Alternatively, not the portion between the middle spring piece unit 222 and the rear end spring piece unit 223, but a portion between the front end spring piece unit 221 and the middle spring piece unit 222 can be twisted, or both portions can be twisted. In addition, in the above embodiments, the power terminal 31 and the ground terminal 32 are altered, but of course, the signal terminal 30 can be altered similarly to the ones described above.

Here, "twist" in this invention includes a twist formed by bending the split spring bar, and also includes the one that is formed by simply turning the split spring bar without bending it. More specifically, "twist" in this invention does not mean only the one which simply makes the split spring bar move upward/downward in the thickness direction in comparison with that before twisting when the cross section of the split spring bar (counter contact section) is viewed in the extending direction. In other words, it does not matter if the "twist" causes such upward/downward movement of the split spring bar, but the "twist" in this invention includes any movement which makes the split spring bar tilt regardless of the upward/downward movement.

The present invention can be widely used for contact terminals of electronic devices using a card, such as cellular phone, PDA, personal computer, and digital camera, or for those devices.

The invention claimed is:

1. A card connector for connecting a card, comprising:
a housing; and
a contact terminal, said contact terminal comprising:
a spring section capable of elastically displacing;
a securing section fixed to the housing; and
a connecting section for connecting to a printed circuit board by soldering,
wherein said spring section includes a plurality of split spring sections, at least one of said split spring sections having a base portion extending from the securing section, and a counter contact section extending from the base portion for contacting to a contact section of the card inserted in said card connector, said counter contact section being twisted around an axis aligned along an extending direction of the counter contact section to form a twist.

2. The card connector according to claim 1, wherein said twist extends over a part of said at least one of the split spring sections.

3. The card connector according to claim 1, wherein said twist extends over substantially a whole part of said at least one of the split spring sections.

4. The card connector according to claim 1, wherein said twist is bent obliquely relative to an extending direction of said at least one of the split spring sections.

5. The card connector according to claim 1, wherein said twist is formed by turning said at least one of the split spring sections.

6. The card connector according to claim 1, wherein said at least one of the split spring sections has a portion having a length or a thickness such that the at least one of the split spring sections has a resonance frequency different from that of the other of the split spring sections.

7. The card connector according to claim 6, wherein said at least one of the split spring sections is secured at a position different from that of the other of the split spring sections such that said portion has the length different from that of the other of the split spring sections.

8. The card connector according to claim 1, wherein said twist is inclined inwardly.

9. The card connector according to claim 1, wherein said twist is inclined outwardly.

10. A contact terminal for a card connector, comprising:
a spring section capable of elastically displacing;
a securing section to be fixed to the card connector; and
a connecting section for connecting to a printed circuit board,
wherein said spring section includes a plurality of split spring sections, at least one of said split spring sections having a base portion extending from the securing section, and a counter contact section extending from the base portion for contacting to a contact section of a card inserted in said card connector, said counter contact section being twisted around an axis aligned along an extending direction of the counter contact section to form a twist.

11. The contact terminal according to claim 10, wherein said twist is bent obliquely relative to an extending direction of said at least one of the split spring sections.

12. The contact terminal according to claim 10, wherein said twist is formed by turning said at least one of the split spring sections.

13. The contact terminal according to claim 10, wherein said at least one of the split spring sections has a portion having a length or a thickness such that the at least one of the split spring sections has a resonance frequency different from that of the other of the split spring sections.

14. The contact terminal according to claim 10, wherein said twist is inclined inwardly.

15. The contact terminal according to claim 10, wherein said twist is inclined outwardly.

* * * * *